United States Patent [19]

Macgilp et al.

[11] 4,290,903

[45] Sep. 22, 1981

[54] PACKAGED FREE FLOWING BLEACH ACTIVATOR PRODUCT

[75] Inventors: Neil A. Macgilp, Morpeth; Duncan A. Mann, Fenham, both of England

[73] Assignee: The Procter & Gamble Company, Cincinnati, Ohio

[21] Appl. No.: 50,236

[22] Filed: Jun. 20, 1979

[30] Foreign Application Priority Data

Jun. 26, 1978 [GB] United Kingdom ..... 27854/78
Jun. 26, 1978 [GB] United Kingdom ..... 27855/78

[51] Int. Cl.[3] ..... C11D 17/04; C11D 17/06

[52] U.S. Cl. ..... 252/91; 252/95; 252/99; 252/135; 252/174.13; 252/186

[58] Field of Search ..... 252/90, 95, 174.13, 252/186, 99, 135

[56] References Cited

U.S. PATENT DOCUMENTS

| | | | |
|---|---|---|---|
| 3,789,002 | 1/1974 | Weber et al. | 252/186 |
| 3,833,506 | 9/1974 | Fries et al. | 252/95 X |
| 3,868,336 | 2/1975 | Mazzola et al. | 252/139 |
| 3,975,280 | 8/1976 | Hachmann et al. | 252/95 X |
| 4,087,369 | 5/1978 | Wevers | 252/102 |
| 4,111,826 | 9/1978 | Leigh et al. | 252/95 X |
| 4,179,394 | 12/1979 | Dillenburg et al. | 252/95 X |
| 4,220,562 | 9/1980 | Spadini et al. | 252/542 |

FOREIGN PATENT DOCUMENTS

| | | | |
|---|---|---|---|
| 859192 | 1/1978 | Belgium . | |
| 226 | 1/1979 | European Pat. Off | 252/90 |
| 1395006 | 5/1975 | United Kingdom . | |
| 1441416 | 6/1976 | United Kingdom . | |

*Primary Examiner*—Mayer Weinblatt

[57] ABSTRACT

A detergent additive product intended to enhance removal of oxidizable and oily stains from textiles comprising a substantially water impermeable container enclosing an organic matrix consisting of 30–85% by weight of a normally solid water soluble ethoxylated nonionic compound and 15–70% by weight of an organic peroxybleach precursor, optionally with 1–75% by weight of the matrix of other water soluble detergent components especially cationic surfactants, organic chelating agents and soil suspending agents. The particulate product has a maximum dimension in the range 1–4 mm, a penetrometer indentation of less than 1 mm, a wicking value (resistance to nonionic bleeding) $<10$ and should disperse in aqueous inorganic persalt-containing detergent solution to release at least 50% of the theoretically available bleach within 8 minutes. In a preferred granular form, the product is coated with 1–30%, by weight of the matrix, of a powder coating which may be organic or inorganic.

4 Claims, No Drawings

PACKAGED FREE FLOWING BLEACH ACTIVATOR PRODUCT

FIELD OF THE INVENTION

This invention relates to detergent additive products and more especially to detergent additive products intended to provide enhanced removal of oxidisable and other stains from textiles when used alone or in combination with conventional heavy duty detergents.

BACKGROUND OF THE INVENTION

Additive products designed to provide enhanced oxidisable stain removal performance are known in the art. Most of these prior art additive products are granular in character and are intended primarily, if not solely, as adjuncts to conventional laundry detergent granules. Such additive products conventionally comprise a bleach or bleach precursor in admixture with a coating or carrier material which serves to enhance the stability of the bleach component and facilitates its uniform dispersion in the granular laundry detergent.

The incorporation of peroxy bleach precursors (hereinafter referred to as bleach activators) into granular additive products is also the subject of numerous prior art disclosures, examples of such disclosures including German Patent Applications DT OS 2650429 and 2651254 and British patent specification Nos. 1,441,416, 1,398,785 and 1,395,006. In general, these disclosures teach the incorporation of a fine particulate peroxy bleach activator, optionally with additional stabilising compounds, into a larger agglomerate, using organic solids having melting points in the range 30°-60° C. as the agglomerating agents.

In all of these prior art disclosures the primary objective has been the formation of a bleach additive granule containing a peroxy bleach activator whose chemical stability could be maintained in a hostile environment eg. during storage under conditions of high temperature and humidity in intimate contact with an alkaline peroxy bleach-containing detergent.

In order to achieve this objective one or other of two techniques has been adopted. In one technique, relatively large quantities (viz. up to 50% by weight of the additive) of one or more non-hygroscopic, sparingly water-soluble or insoluble organic solids of the desired melting point range have been used to form a matrix within which the peroxy bleach activator is dispersed. This provides a particle having acceptable storage stability but requires the incorporation of a significant amount of a non-functional diluent in the product and also imposes limitations on the rate of solubility in aqueous media, particularly at low temperatures.

The other technique has employed a low level (viz. 5-20% by weight of the additive) of agglomerating agent as a binder to hold particles of bleach activator together, for which purpose a wider range of materials has been found acceptable, including the water soluble ethoxylates of higher fatty alcohols and alkyl phenols whose hygroscopicity can be tolerated at low levels of usage.

The use of this technique has minimised the level of diluent, albeit with some sacrifice of the stability of the bleach activator, but at the same time the low level of agglomerating agent has rendered it ineffective for any other purpose even when a surfactant material having detergent functionality has been employed.

In both of these approaches the objective has been to provide a particulate additive product compatible with conventional granular laundry detergents. Although this requirement imposes limitations on the product from the standpoint of chemical stability it does render the flow characteristics of the product less important because advantage can be taken of the good flow characteristics of the base granular detergent. Nevertheless the use of major amounts of hygroscopic materials, such as detergent-functional nonionic surfactants, as agglomerating agents in bleach additive products does lead to both flow and chemical stability problems, if such products are incorporated into conventional laundry detergents.

The additive compositions of the present invention however are not intended to form an integral part of a detergent composition ie. to be stable in intimate mixtures therewith over long periods of storage such as arise during distribution, sale and use of detergent products. The additive products of the present invention are intended to be manufactured and sold as such for use alone or for admixture with conventional detergents at the point of use. In consequence the additive compositions of the present invention need to combine chemical stability, high solubility and good granular flow characteristics.

The present invention seeks, as one of its objectives, to resolve these conflicting requirements by providing a matrix of materials in a particulate form that has satisfactory stability and rate of solution characteristics as made, and packaging the particulate mass so as to restrict the pick-up of moisture to very low levels. The invention also seeks to provide a product having a stain removal capability extending beyond oxidisable stains to greasy oily stains and, in preferred embodiments, to stains susceptible to chemical attack by means other than bleaching.

SUMMARY OF THE INVENTION

According to the present invention there is provided a packaged detergent additive product comprising a container enclosing a solid particulate detergent matrix comprising from 15-70% by weight of the matrix of a powdered organic peroxy bleach activator and from 30-85% by weight of the matrix of water soluble $C_{10}$-$C_{24}$ alcohol ethoxylates, $C_8$-$C_{18}$ alkyl phenol ethoxylates, polyethylene glycols of MWt >4000, and mixtures thereof wherein the matrix has a penetrometer indentation such that when a conical needle of base diameter 15 mm, cone angle 8° and weight 87 g is allowed to fall from a height of 20 mm on to a matrix sample of area >130 mm sq, thickness >20 mm and temperature 32° C. the penetration of the needle is less than 1.0 mm, and a rate of dispersion in an aqueous laundry detergent medium such that in 500 ml of a solution containing 1800 ppm sodium perborate tetrahydrate, 16000 ppm sodium pyrophosphate decahydrate, and 36 ppm EDTA at 25° C., 0.50 g of the matrix will generate at least 50% of the peroxy bleach theoretically available therefrom within 8 minutes of addition to the solution as measured by the titanium of iodine released from an acidified iodine/KI mixture and in that the container material has a moisture vapour permeability such that, when a closed container containing the matrix, at a temperature of 32° C. and a relative humidity of 80%, is held for 42 days, the matrix does not absorb more than 2% by weight of water.

Preferably the rate of dispersion of the matrix in an aqueous laundry detergent medium is such as to generate at least 80% of the peroxy bleach theoretically available from the matrix under the conditions of the test.

In a preferred embodiment of the invention a cationic surfactant is present in an amount such that the weight ratio of nonionic surfactant to cationic surfactant is in the range 20:1 to 1:2 more preferably in the range 5:1 to 1:1. Preferred cationic surfactants include $C_{12}$–$C_{14}$ alkyl trimethyl ammonium salts, $C_{12}$–$C_{14}$ alkyl dimethyl hydroxyethyl ammonium salts and their hydroxypropyl analogues and $C_{11\text{-}13}$ alkyl benzyl trimethyl ammonium salts.

DETAILED DESCRIPTION OF THE INVENTION

As previously stated, the invention comprises a container enclosing a matrix of peroxy bleach activator and one or more water soluble nonionic compounds, the matrix having defined physical characteristics, the container serving to prevent more than 2% moisture pickup by the product after 42 days under accelerated storage conditions. The peroxy bleach activator can be any one of the materials well known in the art and described in detail in the Applicants' German patent application DT OS 2,744,642 published Apr. 13, 1978. Preferred classes of materials disclosed therein are the esters and imides, particularly the tetra acyl alkylene diamines of which tetra acetyl ethylene diamine and tetra acetyl methylene diamine are the most preferred examples.

For the purposes of the invention the activator material should have a mean particle size less than 500 microns preferably less than 300 microns and most desirably less than 150 microns. Such a particle size can either be achieved by adjusting the conditions under which the activator is precipitated or crystallised in the final stages of manufacture or by milling or otherwise reducing the size of the formed crystalline material. Such techniques are well known to those of skill in the art and do not form part of the present invention.

The water soluble nonionic compound can be any one or more of $C_{10}$–$C_{24}$ primary or secondary straight chain or branched alcohol ethoxylates, $C_8$–$C_{18}$ alkyl phenol ethoxylates or polyethylene glycols of Molecular weight $\geqq 4000$ having a melting point in the range 30°–70° C. In order to have the desired physical characteristics the alcohols should be condensed with an average of at least fifteen ethylene oxide groups per mole of alcohol and normally at least twenty ethylene oxide groups. Acceptable alkyl phenol ethoxylates contain at least twenty and preferably at least thirty ethylene oxide groups per mole of alkyl phenol. These highly ethoxylated alcohols or phenols can be mixed with materials having low levels of ethoxylation ie. those in liquid or paste form, provided that the mixture results in a matrix meeting the penetrometer hardness and dispersibility requirements of the invention. Mixtures of this type can be formulated to approach more closely the composition of nonionic surfactants that have optimum grease and oily stain removal capability. Examples of satisfactory materials for the purposes of the present invention include primary linear $C_{14}$–$C_{15}$ alcohol condensed with an average of fifteen moles of ethylene oxide, coconut alcohol condensed with an average of forty-five moles of ethylene oxide, tallow alcohol condensed with twenty moles of ethylene oxide, tallow alcohol condensed with thirty moles of ethylene oxide, tallow alcohol condensed with twenty five moles of ethylene oxide, nonyl phenol condensed with thirty moles of ethylene oxide, polyethylene glycol 6000, polyethylene glycol 10,000 and polyethylene glycol 20,000.

It has been recognised however, that water soluble nonionic compounds which are solid at ambient temperatures (20°–25° C.) but which have penetrometer indentation values at or near the maximum herein defined, can be used to form improved granular particulates if their surfaces are provided with a coating of a powdered material which retains its powdery characteristics under the stated storage conditions. Furthermore, particulates which already have satisfactory flow characteristics can be materially improved in this respect by use of such a powder coating which is described in detail hereinafter.

The matrix of water soluble nonionic compound and peroxy bleach activator comprises from 15%–70% by weight of activator and from 30%–85% by weight of nonionic compound, but normally comprises from 30%–50% activator and 50%–70% nonionic compound. The matrix can be made and formed into a particulate of the desired type by any of the known methods for forming such particulates e.g. by melting the nonionic compound and dispersing the activator therein after which the mixture can be extruded, flaked, or spray cooled, or by spraying the nonionic on to a falling curtain of activator powder in a drum or granulating pan, or by spraying the molten nonionic on to a fluidised bed of the powdered activator. A preferred technique involves dispersion of the powdered activator into the molten nonionic compound followed by cooling and extrusion of the semi-solid mass into noodles. The noodles can be used as formed or processed further into spherical particles using a marumeriser. In general, the maximum particulate dimension can vary between 0.3 mm and 5.0 mm, but in the case of preferred granular particulate forms such as noodles, spheres and agglomerates, the particle size lies in the range 1–4 mm.

For the purposes of the present invention, the matrix should satisfy several physical property criteria. Firstly, the matrix should display a hardness, as defined by the test below, which is related to the flow characteristics of the particulate.

The hardness test measures the distance of penetration of a conical weight dropped onto a sample of the matrix from a height of 20 mm.

The weight comprises a solid cone of base diameter 15 mm and apical angle 8° having a total weight of 87 g. This is supported with the tip of the cone pointing vertically downwards over a sample of the matrix at least 130 mm square and 20 mm thick. The test is carried out at 32° C. and the hardness is judged to be the average of six readings carried out on the same sample. In order to meet the hardness criterion, the matrix should show a penetration of $<1.0$ mm preferably $<0.6$ mm.

Secondly, the matrix should display a wicking value of $<10$. The wicking value is defined as the percentage surface area of an absorbent paper sample in contact with the particulate that has absorbed nonionic material therefrom after storage for seven days in a closed water tight container at 32° C. For the purposes of the test, the particulates should be screened so that they all pass through a screen of mesh opening 2.00 mm and are all retained on a screen of mesh opening 1.00 mm. The size of the paper sample is not critical but is usually within the range 10–50 sq cm, normally about 20 sq cm. Preferably the wicking value is $<5$ and ideally should approach zero.

Thirdly, the matrix should disperse or dissolve in a standard aqueous detergent medium at a speed which permits the generation of at least 50% of the theoretically available organic peroxy bleach species within 8 minutes of addition of the matrix to the medium.

In this test a standard detergent solution is made up containing 16000 ppm tetra sodium pyrophosphate decahydrate, 1800 ppm sodium perborate tetrahydrate and 36 ppm sodium ethylene diamine tetraacetate.

500 ml of this solution is adjusted to a temperature of 25° C. and 0.50 g of the additive product added thereto and agitated using a magnetic stirrer manufactured by Gallenkamp with a speed setting of 3. Within eight minutes of the addition of the additive product to the solution at least one 25 ml aliquot is withdrawn and analysed for the presence of organic peroxy bleach. Each aliquot is added to a mixture of cracked distilled water ice (30 g) and glacial acetic acid (15 ml). Potassium iodide (0.5 g) is added and the mixture is immediately titrated with 0.01 M sodium thiosulphate solution using an iodine indicator ('Iotect' available from British Drug Houses Ltd.) to the first end-point (blue-black→colourless). The compositions embodied in the present invention must generate at least 50% and preferably at least 80% of the theoretically available organic peroxy bleach within 8 minutes of addition of the additive product to the solution.

A particulate product meeting the requirements of these three tests will have acceptable dispersibility whilst retaining its flow characteristics under normal storage conditions in a closed container that permits less than 2% water pick up by weight of the matrix.

As mentioned above, the hardness of the matrix as measured by the penetrometer indentation is related to the flow characteristics of the particulates, as the inherent softness of the matrix affects the structural integrity of the particulates when subjected to storage in bulk. The wicking value also influences the flow characteristics indirectly by reflecting a tendency towards surface stickiness caused by the migration of the more liquid components of the matrix to the surface of the particulate.

The penetrometer indentation and the wicking value taken together are related in the case of granular materials to the cake strength which is a measure of the self adhesion of the granules under load.

As previously mentioned, a preferred form of granular product incorporates a surface powder coating in order to minimize inter-particle stickiness and improve flow from the package. This powder coating comprises a material of particle size $<500\mu$ preferably $<300\mu$ applied so as to give a coating weight of from 0.1%–30% by weight of the uncoated matrix.

The powdered coating material can be organic or inorganic and must retain its powdered character when subjected to prolonged storage under conditions of high humidity and temperature. An accelerated storage test simulating these requirements is that carried out at 32° C. and 80% Relative Humidity where six weeks of storage is considered to be equivalent to six months of storage under normal conditions. In order to be satisfactory, the powdered coating material should not dissolve, melt, coalesce, agglomerate or change physical form on storage. The powder coating can be crystalline or amorphous in character, the only requirement being that it be free flowing itself so that when used as a coating it will promote flow of the coated particles. Preferably crystalline materials should have a cubic, rhombic or other uniformly dimensioned crystalline habit and non crystalline materials such as high MWt polymers should preferably be in spherical form. An example of a suitable organic material is Urea and polymers based thereon. Inorganic materials having high specific surface such as certain forms of silica, talc, smectite clay minerals and synthetic aluminosilicates such as those identified as Zeolites A,B,P, X and Y are particularly suitable, but the most common inorganic salts such as sodium tripolyphosphate, sodium sulphate and magnesium sulphate can also be used provided they are in a stable hydrate form. The mean particle size of the powdered material is normally less than 300 microns preferably less than 150 microns and for materials having high specific surface, the ultimate particle size is normally less than 10 microns and is preferably less than 1 micron.

The coated matrix should have a cake strength of $<0.9$ kg, preferably $<0.7$ kg as measured in the cake strength test described below.

This property reflects the tendency of the coated granules to lump together and not flow freely from the container. The use of the powder coating permits the use of the matrix compositions that would otherwise be unacceptable by reason of their softness and the tendency of the nonionic compound to migrate to the surface of the granular particles of matrix.

Cake Strength Test

A hollow cylinder of internal diameter 65 mm and height 62.5 mm is filled with granules so that the granules are level with the top of the cylinder. A plate having a diameter slightly less than 65 mm is placed on top of the granules and a load of 2.4 kg applied to the plate for 2 minutes to compress the granular sample. The load and confining cylinder are then removed. A downward pointing rod connected to a dial adapted to measure the applied load is then lowered onto the plate at a speed of 45 cm/min and the force (in kg) needed to break the cylinder of granules is measured. Granular products having a cake strength of $<0.9$ kg, preferably $<0.7$ kg, are found to have satisfactory flow properties.

The coated matrix should also satisfy the dispersability requirement that 50% of the theoretically available peroxy bleach should be generated within 8 minutes of introduction of the matrix into an aqueous detergent solution as measured by the test described hereinbefore.

The third essential component of the present invention is a moisture impermeable package enclosing the composition and intended to prevent moisture pick up by the hygroscopic nonionic material. In order that the required physical properties of the composition are maintained, it is necessary that the moisture content of the compositions be kept to a minimum, because at moisture contents exceeding approximately 2.5% by weight of the matrix, the particles of the composition tend to aggregate into larger masses and lose their good flow characteristics. In general, the raw materials from which the composition is formed also contain some water, typically up to 0.5% by weight of the matrix, so that the packaging must be capable of preventing a moisture pick up of approximately 2.0% by weight of the matrix in order for the composition to retain its particulate properties. It has been found that a conventional carton construction is not fully satisfactory in this respect even when cartons having protective barrier layers such as polyethylene or wax lamination are used, although metal foil-wrapped cartons can be employed.

The preferred form of packaging is a canister or more preferably a bottle or flask formed of a moisture impervious material and capable of being resealed during use. Suitable materials include the conventional synthetic plastics packaging materials such as PVC, polyethylene, polypropylene and the various acrylate and styrene-based copolymers. Glass and metal containers can also be used although they are less preferred for aesthetic and cost reasons. In all cases however, packaging suitable for the purposes of the present invention should have a permeability to moisture vapour such that when a matrix composition of the present invention is stored in the closed package for 42 days at 32° C. and 80% relative humidity, the composition does not pick up more than 2% water by weight of the matrix.

In preferred embodiments of the invention the packaging should limit the amount of water pick up to less than 1% and ideally the water pick up on storage should approach zero.

The shape of the container is relatively unimportant subject only to the requirement that its smallest internal cross-sectional dimension should permit flow of the particulate product to take place. The design of the container is within the choice of the user and its construction and method of manufacture form no part of the present invention. Where the container is provided with a replaceable lid or cap, it is convenient to dimension this so that it can be used as a device for measuring quantities of the product for addition to a wash liquor.

Optional Components

A number of optional ingredients can be incorporated into compositions embodied in the present invention so as to increase its efficacy particularly in the area of the removal of a wide range of stains. The total amount of such optional ingredients normally lies in the range 1%–75% preferably 1%–35% by weight of the matrix. The most preferred optional ingredients are those that enhance the removal of stains of an oily nature, or those susceptible to bleaching, as such ingredients are particularly suitable for delivery to a fabric by an additive product.

In order to increase the removal of stains of an oily nature, the addition of a cationic surfactant to the matrix has been found to be useful particularly when the matrix employs a nonionic surfactant as the water soluble nonionic compound.

Suitable cationic surfactants have the empirical formula $$R_m{}^1R^2{}_xY_LZ$$

wherein each $R^1$ is a hydrophobic organic group containing a total of from 8–20 carbon atoms and which may comprise saturated or unsaturated aliphatic groups optionally attached to or substituted by benzyl or phenyl groups and polyethoxy moieties containing up to 20 ethoxy groups, and optionally containing ester, ether or amide linkages, and wherein m is a number from one to three. No more than one $R^1$ in a molecular can have more than 16 carbon atoms when m is 2 and no more than 12 carbon atoms when m is 3. $R^2$ is an alkyl or hydroxyalkyl group containing from 1 to 4 carbon atoms, a polyethylene oxide moiety containing up to 10 ethoxy groups or a benzyl group, with no more than one $R^2$ in a molecule being benzyl, and x is a number from 0 to 3. The remainder of any carbon atom positions on the Y group are filled by hydrogens. Y is selected from the group consisting of:

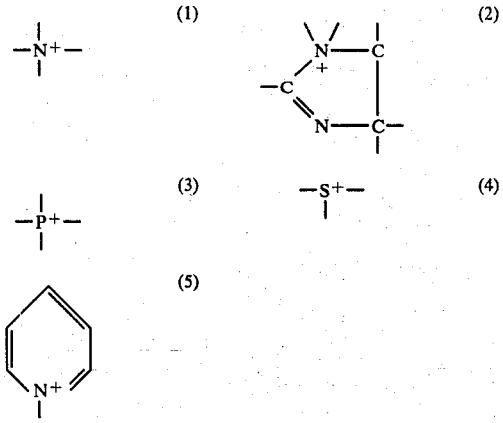

L is a number from 1 to 4, and Z is a water-soluble anion, such as halide, methylsulfate, hydroxide, or nitrate anion, particularly preferred being chloride, bromide or iodide anions, in a number to give electrical neutrality of the cationic component. The particular cationic component to be included in a given system depends to a large extent upon the particular nonionic component to be used in this system, and is selected such that it is at least water-dispersible, or preferably water-soluble, when mixed with said nonionic surfactant. It is preferred that the cationic component be substantially free of hydrazinium groups. Mixtures of these cationic materials may also be used in the compositions of the present invention.

When used in combination with nonionic surfactants, these cationic components provide excellent soil removal characteristics, confer static control and fabric softening benefits to the laundered fabrics, and inhibit the transfer of dyes among the laundered fabrics in the wash solution.

In preferred cationic materials, L is equal to 1 and Y is

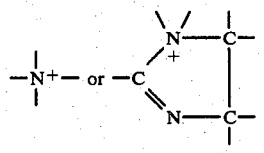

However, L may be greater than 1, such as in cationic components containing 2 or 3 cationic charge centers. Other cationic materials which are useful in the compositions of the present invention include phosphonium, sulfonium, and imidazolimium materials.

Where Y is

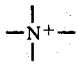

and m=1 it is preferred that x is equal to 3. R is normally a methyl group but one of the $R_2$ groups may be benzyl and one or two groups may be hydroxy $C_2$–$C_4$ alkyl. A preferred structure is where one $R^2$ is hydroxyethyl. Cationic surfactants of this mono long chain type include those in which $R^1$ is a $C_{10}$–$C_{20}$ alkyl group more preferably a $C_{10}$–$C_{16}$ alkyl group or a $C_{10}$–$C_{15}$ alkylbenzyl group. Particularly preferred compositions of this class include $C_{12}$ alkyl trimethyl ammonium bromide, $C_{12}$ alkylbenzyl trimethyl ammonium bromide, $C_{12}$ alkyl dimethyl hydroxyethyl ammonium bromide and $C_{12}$ alkyl dimethyl hydroxypropyl ammonium bromide and their counterparts based on middle-cut coconut alcohol as the source of the alkyl group. Other counter ions such as methosulphate, sulphate, sulphonate and carboxylate can also be used particularly with the hydroxyalkyl-substituted compounds.

Specific examples of hydroxyalkyl substituted compounds are the $C_{10}$–$C_{16}$ dimethyl hydroxyethyl ammonium palmitates, oleates and stearates.

These compounds have a waxy physical form and are relatively non-hydroscopic, thereby facilitating their incorporation into the additive products of the invention.

Where m is equal to 2, only one of the $R^1$ chains can be longer than 16 carbon atoms. Thus ditallowdimethylammonium chloride and distearyldimethylammonium chloride, which are used conventionally as fabric softeners and static control agents in detergent compositions, may not be used as the cationic component in the surfactant mixtures of the present invention. Preferred di-long chain cationics of this type include those in which x is equal to 2 and $R^2$ is a methyl group. In this instance it is also preferred that $R^1$ is a $C_8$ to $C_{12}$ alkyl group. Particularly preferred cationic materials of this class include di-$C_8$ alkyldimethylammonium halide and di-$C_{10}$ alkyldimethylammonium halide materials.

Where m is equal to 3, only one of the $R^1$ chains can be greater than 12 carbon atoms in length. The reason for this chain length restriction, as is also the case with the di-long chain cationics described above, is the relative insolubility of these tri- and di-long chain materials. Where tri-long chain alkyl materials are used, it is preferred that $R^2$ is a methyl group. In these compositions it is preferred that $R^1$ is a $C_8$ to $C_{11}$ alkyl group. Particularly preferred tri-long chain cationics include trioctylmethylammonium halide, and tridecylmethylammonium halide.

Cationic surfactants of this type can be prepared by techniques well known to those skilled in the art and which do not form part of the present invention. However a particularly preferred technique the subject of our copending European Patent Application No. 79200099 entitled "Process for making Detergent Compositions" comprises the quaternisation of a tertiary amine in a liquid polyethylene oxide condensate reaction medium which is itself a component of the present invention. The resultant mixture of a cationic surfactant and a polyethylene oxide condensate can be utilised directly in the invention without isolation of the cationic surfactant per se.

The technique involves dissolving or dispersing a normally non-volatile tertiary amine, containing one or more long chain hydrocarbon residues, in a nonionic polyethoxylate condensate. A relatively volatile quaternising agent having a boiling point less than 200° C., preferably less than 100° C., and most preferably less than ambient temperature, is reacted with this mixture to form the cationic surfactant. The mixture of cationic surfactant and ethoxylate is normally a dispersion which is solid at ambient temperatures and liquid at temperatures greater than approximately 45° C. but certain preferred hydroxyalkyl group-containing quaternary ammonium surfactants having a long chain carboxylate counterion are miscible with polyethoxylated nonionic surfactants and form clear solutions.

Specific examples of these preferred quaternary ammonium surfactants are myristyl dimethyl hydroxyethyl ammonium stearate, lauryl dimethyl hydroxyethyl ammonium palmitate, and lauryl dimethyl hydroxyethyl ammonium oleate. These compounds are non-crystalline low melting solids having acceptable water solubility together with low hydroscopicity and provide, in combination with nonionic surfactant, enhanced grease and oily stain removal.

Because of their waxy nature and their high affinity for conventional solvents, these hydroxyalkyl group-containing quaternary ammonium surfactants are very difficult to prepare in the solvent-free solid state and the above-described technique is a convenient way to obtain them in a form suitable for the purposes of the present invention.

Another useful type of cationic component is a mono quaternary ammonium compound containing one long chain hydrocarbyl group interrupted by ester and/or amide groups. This is described in our copending Japanese Patent Application No. 79-39413 published Mar. 26, 1979, the disclosures of which are incorporated herein by reference.

This particular type of cationic component is environmentally desirable, since it is biodegradable, both in terms of its long alkyl chain and its nitrogen-containing segment. It is useful in nonionic/cationic surfactant mixtures which have a ratio of nonionic to cationic of from about 10:6 to about 20:1, but in the compositions of the present invention, it is more generally used in mixtures having nonionic to cationic ratios of from about 10:2 to about 10:6, particularly from about 10:3 to 10:5, most preferably about 10:4. These preferred cationic surfactants may also be used in our copending European Patent Application No. 0000235 published Jan. 10, 1979 and incorporated herein by reference, in nonionic to cationic ratios of from 8:1 to 20:1.

Preferred cationic surfactants of this type are the choline ester derivatives havint the following formula:

$$R^2-\overset{\overset{\displaystyle O}{\|}}{C}-O-CH_2CH_2-\overset{\overset{\displaystyle CH_3}{\|}}{\underset{\underset{\displaystyle CH_3}{\|}}{N^+}}-CH_3X^-,$$

as well as those wherein the ester linkages in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{16}$ alkyl), myristoyl choline ester quaternary ammonium halides ($R^2=C_{13}$ alkyl), lauroyl choline ester ammonium halides ($R^2=C_{11}$ alkyl), and tallowoyl choline ester quaternary ammonium halides ($R^2=C_{16}$–$C_{18}$ alkyl).

Additional preferred cationic components of the choline ester variety are given by the structural formulas below, wherein p may be from 0 to 20.

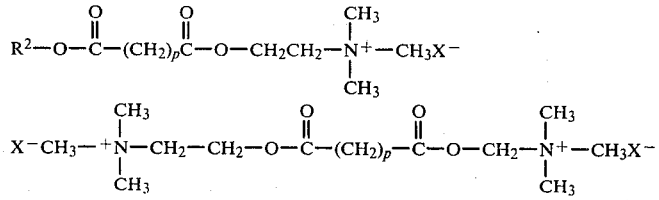

The preferred choline-derivative cationic substances, discussed above, may be prepared by the direct esterification of a fatty acid of the desired chain length with dimethylaminoethanol, in the presence of an acid catalyst. The reaction product is then quaternized with a methyl halide, forming the desired cationic material. The choline-derived cationic materials may also be prepared by the direct esterification of a long chain fatty acid of the desired chain length, together with 2-haloethanol, in the presence of an acid catalyst material. The reaction product is then used to quaternize triethanolamine, forming the desired cationic component.

These novel cationic surfactants may be used in nonionic/cationic surfactant mixtures in a ratio of nonionic component to cationic component of from about 10:6 to about 20:1. When these surfactants are used in the compositions of the present invention they are preferably used in nonionic to cationic ratios of from about 10:6 to about 10:2, but they may be also used in the nonionic/-cationic surfactant mixtures disclosed in the previously mentioned European Patent Application No. 0000235 wherein the ratio of nonionic component to cationic component would be from about 8:1 to about 20:1. These surfactants, when used in the compositions of the present invention, yield excellent particulate soil, body soil, and grease and oil soil removal. In addition, the detergent compositions control static and soften the fabrics laundered therewith, and inhibit the transfer of dyes in the washing solution. Further, these novel cationic surfactants are environmentally desirable, since both long chain alkyl segments and their nitrogen segments are biodegradable.

In general, the weight ratio of the cationic surfactant to the nonionic surfactant component of the matrix, lies in the range 2:1 to 1:20, preferably 1:1 to 1:5, and most preferably 2:3 to 1:3.

The cationic surfactant can be incorporated into the additive products of the invention in various ways well known to those skilled in the art. Thus the cationic surfactant can be dispersed or solubilised in the nonionic compound together with the activator or may be incorporated by granulation using the molten matrix as the agglomerating agent or can be mixed in the semi-solid matrix prior to milling or extrusion to form respectively flakes and noodles.

A preferred technique of addition of cationic surfactants to nonionic surfactants is disclosed in the previously mentioned copending European Patent Application No. 79200099 in which the cationic surfactant is formed in situ in a nonionic surfactant which is used as the reaction medium for the quaternization of a suitable tertiary amine. This technique provides a uniform dispersion of the cationic surfactant and also avoids the use of volatile solvents and/or water (common in commercially available quaternary ammonium surfactants) which require removal before the cationic surfactant can be used in products of the present invention. Using the above technique the mixture of nonionic and cationic surfactants can then be utilised to incorporate the bleach activator in the same manner as for the nonionic surfactant on its own.

In addition to the cationic surfactant, other optional ingredients can also be added to the matrix of activator and water soluble nonionic compound.

Thus surfactants other than the nonionic and cationic surfactants specified hereinbefore, suds modifiers, chelating agents, anti-redeposition and soil suspending agents, optical brighteners, bactericides, anti-tarnish agents, enzymatic materials, fabric softners, antistatic agents, perfumes and bleach catalysts can all be introduced into a wash liquor by means of the additive products of the present invention.

The surfactant can be any one or more surface active agents selected from anionic, zwitterionic, non-alkoxylated nonionic and amphoteric classes and mixtures thereof. Specific examples of each of these classes of compounds are disclosed in Laughlin & Heuring U.S. Pat. No. 3,929,678 issued Dec. 30, 1975 which is hereby specifically incorporated herein by reference.

These optional surfactants can be incorporated at levels such that the nonionic:non cationic optional surfactant weight ratio $\geqq 2:1$.

Other optional ingredients include suds modifiers particularly those of suds suppressing type, exemplified by silicones, and silica-silicone mixtures.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

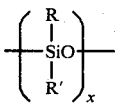

wherein x is from about 20 to about 2,000 and R and R′ are each alkyl or aryl groups, especially methyl, ethyl, propyl, butyl and phenyl. The polydimethylsiloxanes (R and R′ are methyl) having a molecular weight within the range of from about 200 to about 2000,000, and higher, are all useful as suds controlling agents. Additional suitable silicone materials wherein the side chain groups R and R′ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 1(:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German Patent Application DTOS 2646127 published Apr. 28, 1977 and incorporated herein by reference. An example of such a compound is DC-544, commercially available from Dow Corning, which is a siloxane/glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Separate suds modifier particulates are especially preferred for compositions incorporating a cationic surfactant grease removal component. Techniques for forming such suds modifying particulates are disclosed in the previously mentioned Bartolotta et al U.S. Pat. No. 3,933,672.

Chelating agents that can be incorporated include citric acid, nitrilotriacetic and ethylene diamine tetra acetic acids and their salts, organic phosphonate derivatives such as those disclosed in Diehl U.S. Pat. No. 3,213,030 issued Oct. 19, 1965, by Roy U.S. Pat. No. 3,433,021 issued Jan. 14, 1968, Gedge U.S. Pat. No. 3,292,121 issued Jan. 9, 1968, Bersworth U.S. Pat. No. 2,599,807 issued June 10, 1952, and carboxylic acid builders such as those disclosed in Diehl U.S. Pat. No. 3,308,067 issued Mar. 7, 1967, all of the foregoing patents being hereby incorporated herein by reference. Preferred chelating agents include nitrilotriacetic acid (NTA), nitrilotrimethylene phosphonic acid (NTMP), ethylene diamine tetra methylene phosphonic acid (EDTMP) and diethylene triamine penta methylene phosphonic acid (DETPMP), and the chelating agents are incorporated in amounts such that the chelating agent level does not exceed 10% by weight of the activator-nonionic compound matrix.

Preferred soil suspending and anti-redeposition agents include methyl cellulose derivatives and the copolymers of maleic anhydride and either methyl vinyl ether or ethylene.

Another class of stain removal additives useful in the present invention are enzymes.

Preferred enzymatic materials include the commercially available amylases, and neutral and alkaline proteases conventionally incorporated into detergent compositions. Because of their heat sensitivity, these materials require incorporation at or close to ambient temperatures and thus addition to a melt of the precursor and other additives is not possible. Accordingly enzymatic materials are best incorporated by adding them to the semi-solid matrix prior to extrusion or milling to form the particulate product. Separate addition as a prilled material is a preferred technique where a prilled or granulated matrix is produced.

The invention is illustrated in the following examples in which all percentages are by weight unless otherwise stated.

EXAMPLE 1

600 g of Tallow alcohol condensed with an average of 25 moles of ethylene oxide per mole of alcohol were melted at 55° C. and 500 g of powdered tetra acetyl ethylene diamine having a mean particle size of approx 150 microns was added to the melt and uniformly dispersed using a Morton Mixer. The semi-solid mass was then fed to an extruder and formed into cylindrical prills of 1 mm dia 1–4 mm length. The matrix had a penetrometer indentation at 32° C. of 0.5 mm using the hardness test previously described and the dispersibility of the prills at 25° C. using the previously defined test was such as to release 92% of the available peroxy bleach in 8 minutes, the maximum release being 94% after 11 minutes.

The prills were crisp and free flowing and showed no appreciable moisture pick-up and a wicking value of $\approx 0$ after storage in a sealed polyethylene jar for 42 days at 32° C. and 80% relative humidity.

EXAMPLE 2

The following products were made up into prills using the procedure of Example 1.

| | A | B | C | D |
|---|---|---|---|---|
| TAED | 500 | 500 | 500 | 500 |
| $TAE_{25}$ | 600 | 0 | 0 | 400 |
| Primary $C_{14}$–$C_{15}$ alcohol $E_{15}$ | 0 | 600 | 200 | 0 |
| Polyethylene glycol 6000 | 0 | 0 | 200 | 0 |
| $C_{14}$ Alkyl trimethyl Ammonium Bromide | 300 | 300 | 200 | 200 |
| Ethylene diamine tetra methylene phosphonic acid. | 50 | 50 | 50 | 50 |
| Methyl vinyl ether maleic anhydride copolymer MWt 250,000 | 30 | 30 | 30 | 30 |
| Optical brightner | 10 | 10 | 10 | 10 |
| Stearic Acid | 0 | 0 | 200 | 0 |

The products had the following properties as measured using the previously defined tests

| | A | B | C | D |
|---|---|---|---|---|
| Penetrometer Indentation (mm) | 0.5 | 1.0 | 0.85 | 0.7 |
| % Release of peroxy bleach | 94% | 94% | 33% | 94% |
| Wicking Value (1 week) | ≅0 | ≅30 | ≅0 | 0 |

Storage of all these products in sealed polyethylene jars in a 32° C., 80% RH environment for 42 days resulted in no appreciable moisture pick up and products A, C and D maintained their good granular flow properties. Product B however became sticky because of the wicking of nonionic surfactant from the interior to the exterior of the prill surfaces and its flow characteristics became unacceptable. Product C was also unacceptable because the incorporation of fatty acid into the prill reduced its dispersibility to less than the minimum required for the present invention. Storage of Product D under similar conditions in wax laminated paperboard cartons led to a moisture pick up of 2% after four weeks and the coalescence of the prills into a solid mass.

EXAMPLE 3

The procedure of Example 2 was followed using a product identical to product A except that the 600 g $TAE_{25}$ was replaced by a mixture of 340 g $TAE_{25}$ and 260 g $TAE_3$. The TAED-alcohol ethoxylate matrix gave a penetrometer indentation of 0.9 mm using the prescribed test and in the dispersibility test the prilled product gave a release of 52% after 8 minutes with the maximum not being reached within 16 minutes. Storage of the product in a sealed polyethylene jar for 42 days in a 32° C. 80% Relative Humidity environment gave no appreciable moisture pick up but led to some bleeding of the liquid nonionic surfactant from the prill.

EXAMPLE 4

A prill was prepared as in Example 1 and was mixed in a ratio of 3:1 by weight with an additional prill designed to provide suds control. This suds control prill was prepared by first heating a mixture of behenic acid and $TAE_{25}$ (4:1 by weight) to a temperature of 80° C. to give a molten mass and then adding a finely ground high melting point paraffin wax (90°-95° C.) in an amount such that the proportions of Fatty Acid:$TAE_{25}$:Wax were 4:1:4 by weight, after which the molten mass was cooled to about 25° C. and then extruded using the technique of Example 1 to form prills of 1 mm diameter and 1-4 mm length. The addition of this suds control prill had no effect on the dispersibility or the flow properties of the peroxy bleach activator containing prill and led to the generation of a low level of suds when used with a conventional laundry product in an automatic washing machine at temperatures of 80° C. and above.

EXAMPLE 5

500 g of tetraacetyl ethylene diamine, 200 g of $C_{14}$ alkyl trimethyl ammonium bromide, 50 g of ethylene diamine tetra methylene phosphonic acid and 30 g of methyl vinyl ether maleic anhydride copolymer of MWt 250,000, were added to 400 g of molten $TAE_{25}$ at 60° C. The composition was mixed in a Z-blade mixer until it was a uniform pasty mass, after which it was cooled and extruded at 25° C. to form noodles of diameter 1 mm and length 1-4 mm.

Using the previously defined test methods for dispersibility and wicking value, the product displayed a dispersibility of 94% after 8 minutes and a wicking value approaching zero. There was no water pick-up on storage in a closed polyethylene container at 32° C. and 80% RH for 42 days. The product was then powder coated by tumbling in a horizontal rotary mixing drum with granular sodium tripolyphosphate of mean particle size $\approx 300\mu$ to give a powder take-up of 20% based on the weight of the uncoated product (corresponding to 26.6% by weight of the matrix). A cake strength test was then carried out using the method defined hereinbefore, and gave a reading of 0.6 kg, showing the benefits obtainable by the use of powder coating.

EXAMPLE 6

The procedure of Example 5 was repeated with a mixture of the following composition.

| | |
|---|---|
| TAED | 500g |
| $C_{14}$ trimethyl ammonium bromide | 200g |

-continued

| | |
|---|---|
| EDTMP | 50g |
| $C_{14}$-$C_{15}$ alcohol ($E_{15}$) | 300g |
| $TAE_{25}$ | 200g |
| PEG 6000 | 100g |
| Maleic anhydride methyl vinyl ether copolymer (Mwt 250,000) | 30g |

the mixture being formed into a prilled product of diameter 1 mm and length 1-4 mm. A penetrometer hardness test on the matrix, comprising TAED and the mixture of PEG and ethoxylated alcohols, gave an indentation of 1.05 mm which is marginally greater than that deemed to be satisfactory for acceptable hardness. The product also had a dispersibility of 83.3% and a wicking value of approximately 5%, with no detectable water pick-up after storage in a closed polyethylene container for 42 days at 32° C. Samples of the prilled product were then coated with granular sodium tripolyphosphate as in Example 5 to give an uptake of 10% and 20% based on the weight of the uncoated product (i.e. corresponding to 12.6% and 25.2% of the weight of the matrix).

Cake strength tests carried out on these two coated prilled products gave values of 0.8 kg and 0.42 kg respectively, illustrating the beneficial value of powder coating for a product, the matrix of which has marginally unnaceptable hardness.

EXAMPLE 7

600 g of tallow alcohol condensed with an average of 25 moles of ethylene oxide per mole of alcohol was melted at 55° C. and 500 g of powdered tetra acetyl ethylene diamine, having a mean particle size of approx 150 microns, was added to the melt and uniformly dispersed using a Morton Mixture. 300 g of $C_{14}$ alkyl trimethyl ammonium bromide, 50 g of EDTMP, 30 g of methyl vinyl ether maleic anhydride copolymer (Mwt 250,000) and 10 g of an optical brightener were then added to the mixture to form a semi-solid mass which was fed to an extruder and formed into cylindrical prills of 1 mm diameter and 1-4 length. The matrix had a penetrometer indentation of 0.5 mm at 32° C. using the previously described test. The dispersibility of the prills at 25° C. was such as to release 94% of the available peroxy bleach in 8 minutes with a maximum release of 96% after 11 minutes.

The prills were then mixed with a quantity of suds control prills made in the following manner. A mixture of behenic ($C_{22}$) acid and $TAE_{25}$ (4:1 by weight) was heated to a temperature of 80° C. to give a molten mass. A finely ground high melting point (90°-95° C.) paraffin wax was then added in an amount to give a composition in which the ratio of fatty acid: $TAE_{25}$:wax was 4:1:4 by weight. The molten mass was then cooled to 25° C. and extruded to give prills of the same size as those incorporating the peroxy bleach activator. These suds control prills were then added to the activator-containing prills in a weight ratio of 3 parts of activator prills to 1 part of suds control prills. The mixture of prills was then dust coated with powdered sodium tripolyphosphate of mean particle size $<150\mu$ in an amount of 5% based on the prill mixture. Finally, perfume in an amount of 0.25% by weight of the uncoated mixed prills was sprayed on to the product in a mixing drum.

The final product had a cake strength of 0.7 kg, displayed a wicking value approaching zero and no measurable moisture pick up after 42 days storage in a closed polyethylene container maintained in a 32° C., 80% Relative Humidity environment.

We claim:

1. Process for preparing free flowing granular bleach activator product comprising the steps of (a) contacting powdered bleach activator with molten organic compound to form granular product with a particle size ranging from about 1 to about 4 mm maximum dimension, said granular product comprising a matrix of (i) from about 15% to about 70% bleach activator and (ii) from about 85% to about 30% of said organic compound, said bleach activator being selected from the group consisting of tetra acetyl ethylene diamine and tetra acetyl methylene diamine and mixtures thereof, said organic compound being selected from the group consisting of $C_{10}$–$C_{24}$ primary and secondary alcohol ethoxylates having an average of at least 15 ethylene oxide groups per mole of alcohol, $C_8$–$C_{18}$ alkyl phenol ethoxylates containing at least 20 ethylene oxide groups per mole of alkyl phenol, polyethylene glycols of molecular weight greater than 4000, and mixtures thereof;

(b) contacting the granules of said granular product with sodium tripolyphosphate particles of size less than 500 microns to provide a surface coating thereon of said sodium tripolyphosphate particles at a level ranging from about 0.1% to about 30% by weight of said matrix;

to thereby provide granular bleach activator product with a flowability defined by a cake strength of less than about 0.9 kg and characterized by a rate of dispersion such that after addition into a standard detergent peroxy bleach solution at least 50% of the organic peroxy bleach theoretically available from the bleach activator is generated within 8 minutes.

2. A process as recited in claim 1, in which step (a) involves dispersion of the powdered activator into the molten organic compound, followed by cooling, and extrusion into particles, and in which step (b) involves tumbling of the product of step (a) with said sodium tripolyphosphate particles, and in which the organic compound is selected from the group consisting of $C_{10}$–$C_{24}$ primary and secondary alcohol ethoxylates having an average of at least 15 ethylene oxide groups per mole of alcohol and polyethylene glycols of molecular weight greater than 4000 and mixtures thereof, and in which said activator is tetra acetyl ethylene diamine.

3. A process as recited in claim 2 in which said organic compound comprises said alcohol ethoxylate and in which cationic surfactant is added in step (a) to provide product with a weight ratio of said cationic surfactant to said alcohol ethoxylate lying in the range from 2:1 to 1:20.

4. A process as recited in claim 3 including the additional step of enclosing the product of step (b) in a container having a moisture vapor permeability such to prevent a moisture pickup of more than about 2% by weight of matrix upon storage for 42 days at 32° C. and 80% relative humidity.

* * * * *